US005317129A

United States Patent [19]

Taplan et al.

[11] Patent Number: 5,317,129

[45] Date of Patent: May 31, 1994

[54] COOKING RANGE

[75] Inventors: Martin Taplan, Ingelheim; Stefan Hubert, Wiesbaden; Herwig Scheidler, Mainz, all of Fed. Rep. of Germany

[73] Assignee: Schott Glaswerke, Mainz, Fed. Rep. of Germany

[21] Appl. No.: 925,018

[22] Filed: Aug. 5, 1992

[30] Foreign Application Priority Data

Mar. 27, 1992 [DE] Fed. Rep. of Germany ..... 4210010

[51] Int. Cl.[5] ..... H05B 3/68; F24C 3/00; F24C 15/10

[52] U.S. Cl. ..... 219/464; 126/39 B; 126/211

[58] Field of Search ..... 219/464, 467; 126/39 B, 126/211, 39 H

[56] References Cited

U.S. PATENT DOCUMENTS

| | | | |
|---|---|---|---|
| 2,213,234 | 9/1940 | Tinnerman | 219/464 |
| 3,348,025 | 10/1967 | Bassett | 219/467 |
| 4,453,533 | 6/1984 | Scheidler et al. | 126/219 |
| 4,492,217 | 1/1985 | Scheidler | 219/464 |

FOREIGN PATENT DOCUMENTS

| | | | |
|---|---|---|---|
| 0162621 | 11/1985 | European Pat. Off. | F24C 15/10 |
| 7718108 | 9/1977 | Fed. Rep. of Germany . | |
| 7719859 | 9/1977 | Fed. Rep. of Germany . | |
| 3104114A1 | 10/1979 | Fed. Rep. of Germany . | |
| 2819118A1 | 8/1982 | Fed. Rep. of Germany . | |
| 3126013 | 4/1983 | Fed. Rep. of Germany . | |
| 8624136 | 12/1986 | Fed. Rep. of Germany . | |

*Primary Examiner*—Bruce A. Reynolds
*Assistant Examiner*—Michael D. Switzer
*Attorney, Agent, or Firm*—Michael D. Bednarek

[57] ABSTRACT

A cooking range with a cooking zone plate made of glass, glass ceramics or similar materials. A frame for the cooking zone plate serves as edge protection on the one hand and as closing for the upper edge of the plate. On the other hand, the cooking zone plate is bonded with the frame on the edge side.

According to the invention, the frame includes an attachment frame part and a visual frame part separated from the attachment frame part. The attachment frame is a standardized component that is connected with the lower plate edge. The visual frame serves as protection edge and upper closing. In this way a frame modular system can be put together for all applications in a simple, economical manner.

19 Claims, 11 Drawing Sheets

COOKING RANGE

BACKGROUND OF THE INVENTION

The invention relates generally to a cooking range with a cooking plate made of glass, glass ceramics or a similar material, and particularly to a framing means for framing the cooking plate. The framing means may have attachment means that are bonded with the edge of the plate, means of edge protection and lateral closure of the plate, and a cooking range casing that surrounds the plate at its bottom and has sides and a bottom.

Such a cooking range was made known from German patent DE 31 26 013 C2.

In the known case, the frame is designed in one piece. Seen from the side, it has a middle ridge on which, at the proper level, a flange is formed that can be bonded to the lower rim of the plate. This flange holds the plate, so to speak. The section of the frame projecting over this, i.e., the outer flange, protects the shock-sensitive edges of the plate, a necessity particularly with brittle glass or glass ceramic plates. Furthermore, this section of the frame forms the transition to the sill plate in the case of built-in cooking ranges or for outside covering in the case of upright stoves. In this instance, the part of the flange that is visible from the outside must meet aesthetic and hygienic requirements. The familiar cooking range also has a cooking range casing designed in one piece, which takes in the frame and which has heating elements and the like arranged on its bottom. To be able to be gain access to the inside of the cooking range for a repair, the frame with the plate bonded in place is attached on the cooking range casing via a detachable snap and screw connection and can be removed by lifting it upward.

Comparable one-piece frames with another detachable connection to the cooking range casing are also shown in German patents DE-U 86 24 136 and 77 18 108.

The known cooking ranges with one-piece frames have the disadvantage that a frame built for an upright stove cannot also be used as frame for a built-in stove and vice versa. For this reason, a new design of the frame is necessary for an upright stove as well as for a built-in stove, with additional, expensive production tools also needed.

SUMMARY OF THE INVENTION

The invention is therefore based on the task of creating a cooking range of the type described at the beginning in which the frame is flexible in that it is adapted to be used with upright stoves as well as built-in stoves, with the greatest degree of standardization, i.e., the same frame can be used for different applications.

This task is solved according to the invention by providing the framing means with an attachment frame that is bonded to the circumferential edge of the plate on its bottom, and a visual frame designed separate from the attachment frame, with means of edge protection and lateral closing of the plate.

The advantages of the invention lie in the fact that by the bisection of the frame and formation of an attachment frame and visual frame, a component is created which is on the one hand standardized and remains the same for all forms of construction of a stove and, on the other hand, is individually adaptable. The attachment frame that is equally usable for upright stoves and for built-in stoves saves money in construction and production. The visual frame can be easily adapted to the various forms of construction of a stove. In this case, the attachment frame is for receiving the visual frame, attaching the cooking plate, receiving/mounting the other components such as heating bodies, residual heat indicator, etc. and for attachment to the rest of the stove construction.

The forming of the lateral walls of the cooking range casing by the attachment frame has the result of saving material. For repair purposes, one can gain access in a simple manner to the inside of the cooking range by detaching the attachment between the attachment frame and the bottom group.

The construction of the cooking range according to the invention thus allows an advantageous frame-modular construction for cooking zone plates of glass/glass ceramics or similar materials for simple, flexible adaptation to different product requirements while using frame components with the greatest degree of standardization, preferably for use in upright stoves and built-in cooking zones as edge enclosure/edge protection of the cooking surfaces and as a basic element for receiving-/attaching further cooking zone components. The stoves can be electric or gas-operated. The frame-modular construction according to the invention is very flexible and adaptable in a simple, economical manner to different requirements while largely preserving the frame-components and the attachment elements for other components (heating bodies, residual heat indicator, etc.).

A form of construction of the invention is characterized in that the attachment frame, seen from the side, has a middle ridge running vertically in the installed position and forming the lateral walls of the cooking range casing, and a connecting flange bent upward at the lateral walls and serving the purpose of bonding with the lower rim of the plate, and a connecting flange bent downward and serving the purpose of attachment of the bottom part of the cooking range. This design provides a very simply structured attachment frame.

This advantage is noticeable particularly when, as a result of a further development, the attachment frame has a C-shaped cross-section.

To improve the bonding between the cooking zone plate and the connecting flange grasping the bottom of the rim of the plate, the attachment frame has bores in the connecting flange for partial passage of adhesive.

Because of these bores in the connecting flange, an additional form-locking connection is achieved during bonding with the cooking zone plate, since during bonding, the adhesive presses through the bores and migrates behind them. This measure makes any pretreatment of the adhesion surface of the attachment frame no longer necessary.

So that the adhesive flowing through the bores cannot drip downward, according to a further development of the invention a collecting collar for adhesive is arranged below and parallel to the connecting flange of the attachment frame.

Instead of the above-mentioned bores in connection with a collecting collar, rear catching bars in the connecting flange, formed by stamping and bending, can be used.

The connecting flange of the attachment frame can be bent toward the cooking range interior or away from the cooking range wall. In the first case the lateral walls of the cooking range and in the second case the outer edge of the connecting flange are snugly bonded with the plate rim. These two possibilities provide different attaching possibilities of the attachment frame in the cooking range.

Another form of construction of the invention is characterized in that the visual frame, as seen from the side, also has a middle ridge running vertically in the installed position. This forms a wall of the middle ridge, which embraces the lateral walls formed by the middle ridge of the attachment frame. Such a design results in simple attachment possibilities and easy mounting.

A number of forms are possible for the visual frame. Particularly advantageous are constructions in which the visual frame has covering collars bent adjacent to the upper end of the middle ridge. These covering collars can be designed in different ways and can be connected in different ways with the cooking zone plate or the stove wall or the sill plate in the case of a built-in cooking range. Advantageous constructions are characterized in the subclaims.

A particularly useful cooking range is one in which, in installed position, a circumferential seal is arranged between the visual frame and the lateral edges of the plate and has its upper surface snugly joining the upper edge of the plate with the upper edge of the visual frame. Because of the smooth, uninterrupted transition, a cooking range designed in this way is easy to clean and is problem-free with regard to hygiene.

BRIEF DESCRIPTION OF THE DRAWINGS

The invention is explained in greater detail with the help of forms of construction shown in the drawings. These show further constructions and advantages of the invention.

DETAILED DESCRIPTION OF THE DRAWINGS

Figure 1:
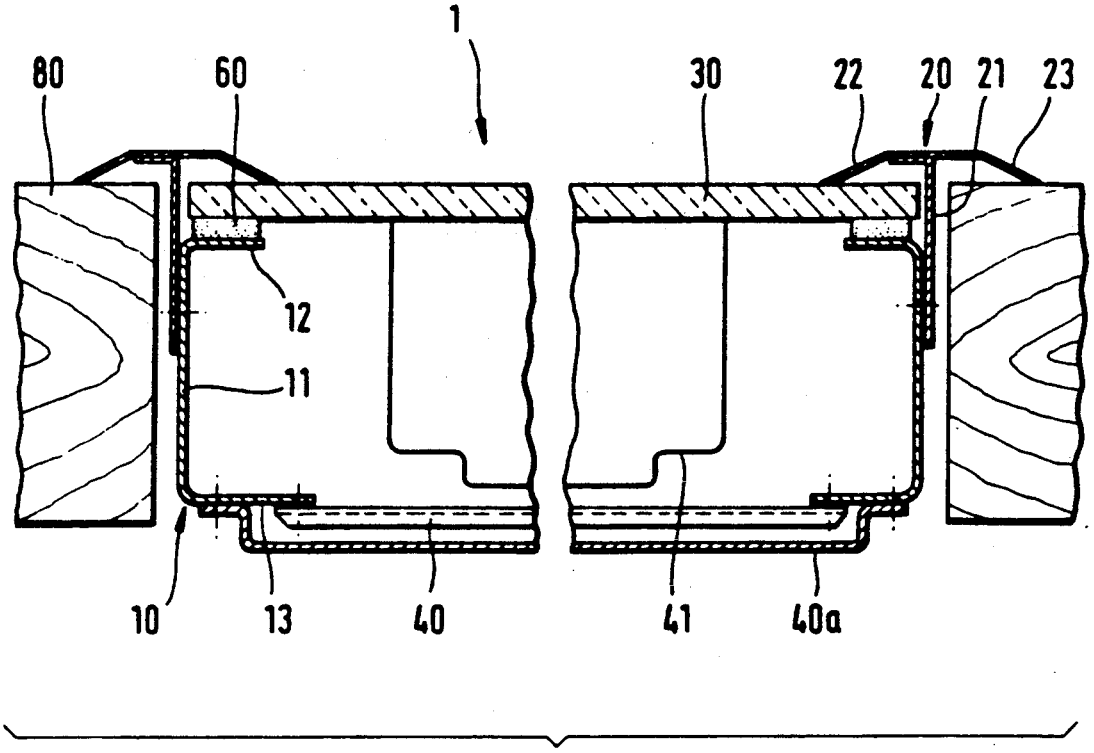
FIG. 1 shows a cooking range in cross-section with a frame for a built-in stove.

FIG. 1 shows a cooking range 1 of a built-in stove. It is built into a sill plate 80. The cooking range has a cooking zone in the form of a glass ceramics plate 30. For such cooking zones, glass plates or plates of similar materials can also be used in a familiar way. The cooking range is limited to the inside by a cooking range casing the elements of which will be explained later.

To hold the glass ceramics plate 30 and to protect its edges, there is a bisectioned frame composed of an attachment frame 10 and a visual frame 20.

The cross-section of the attachment frame 10 has a C-shaped profile with a vertically running middle ridge 11 forming the lateral walls of the cooking range casing. In addition, the attachment frame 10 has a connecting flange 12 bent upward. This flange is connected with the lower rim of the glass ceramics plate 30 via an adhesive layer 60. The attachment frame 10 is screwed into a base plate 40 of the cooking range casing via a connecting flange 13 bent downward. The heating bodies of the cooking zone are arranged on this base plate 40. For the sake of simplicity, only their casings 41 are shown. The other components such as residual heat indicators and the like are also arranged on the bottom plate 40 in typical manner. With the connecting flange 13 a casing part **40*a* that constitutes the bottom of the cooking range casing is also connected under the bottom plate 40**.

Seen from the side, the visual frame 20 also has a middle ridge 21 running vertically in the installed position, and the (circumferential) wall formed by this ridge encloses nearly free from play the lateral walls formed by the middle ridge 11 of the attachment frame 10. This causes the position of the two frame parts 10 and 20 in relation to each other to be fixed, in such a way that both parts can be easily screwed to each other.

Adjacent to the upper end of the middle ridge 21, the visual frame 20 has a covering collar 22 bent inward, covering the upper edge of the glass ceramics plate 30 and forming the closing of this area.

The visual frame 20 according to FIG. 1 designed for a built-in stove also has, adjacent to the upper end of the middle ridge 21, a covering collar 23 bent outward and forming the closing with the sill plate 80.

The covering collars 22 and 23 are for protecting the edges of the cooking zone plate 30 on the one hand and, on the other hand, they form the closing to the upper plate edge and to the sill plate.

As can be seen from FIG. 1, the middle ridge 21 of the visual frame projects somewhat over the upper edge of the cooking zone plate 30, while the two covering collars are each bent in ramp shape toward the top of the cooking zone or sill plate. The individual construction possibilities for the design of the covering collars will be explained later.

Figure 2:
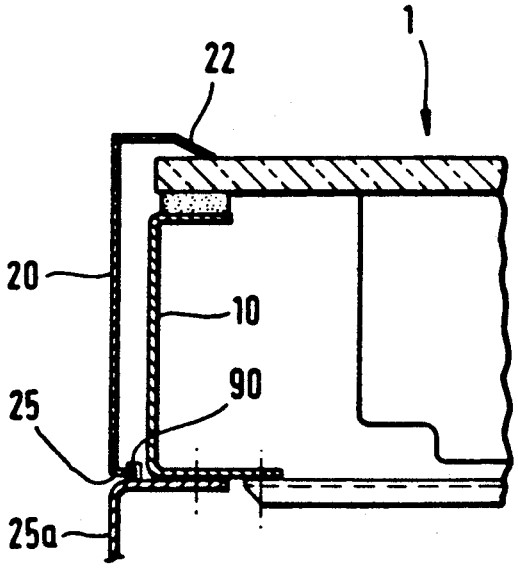
FIG. 2 shows the left circumferential area of the cooking range according to FIG. 1, but with a frame for an upright stove.

Unlike FIG. 1, FIG. 2 shows a cooking range 1 built into an upright stove. This range also has a bisectioned frame consisting of the attachment frame 10 and the visual frame 20. The attachment frame 10 is bonded with the cooking zone plate corresponding to the cooking range in Pig. 1.

If the two figures are compared with respect to the attachment frame 10, it turns out that both attachment frames 10 are identical. The attachment frame 10 thus constitutes a standardized component remaining the same for all versions of a stove. Only the visual frame 20 needs to be adapted to the various versions of a stove.

The visual frame 20 according to FIG. 2, built for the upright stove, forms the upper visible covering which is fitted in form-locking manner. For this, lower legs 25 of the visual frame 20 are hooked into hooks 90 of the lower visible stove covering 25*a*, with the lower covering 25*a* in turn screwed on to the attachment frame 10. For mounting reasons, the visual frame 20 consists of four individual side parts that can be screwed together.

Unlike FIG. 1, where the visual frame 20 is immediately screwed together with the attachment frame 10, the visual frame 20 in FIG. 2 is thus indirectly connected with the attachment frame 10 via the hooks 90 of the lower covering 25*a*.

The visual frame 20 of FIG. 2 also has, adjacent to the upper end of the middle ridge, a covering collar 22 bent toward the cooking zone plate 30. Its specific design will be comparatively explained later.

FIGS. 1 and 2 show certain forms of construction of the connection of the frame parts 10 and 20 with each other and with the base plate 40 or the bottom part 40*a* and the other stove wall 25*a* (in the case of FIG. 2). An expert has a number of possibilities in this instance. For example, in the case of FIG. 1 it is conceivable to pull the middle ridge 21 of the visual frame down to the bottom of the cooking range and to connect it there with the attachment frame as well as with the bottom part 40*a*.

Figure 4:
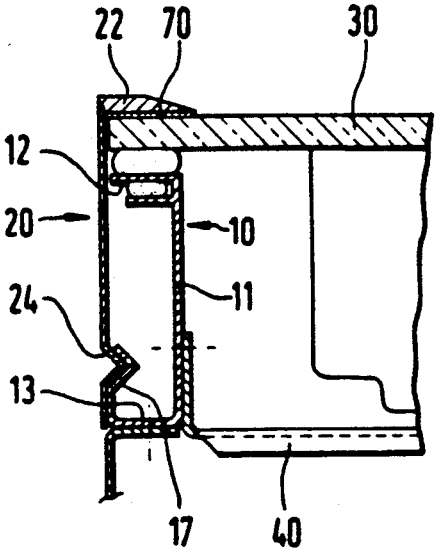
Figure 6:
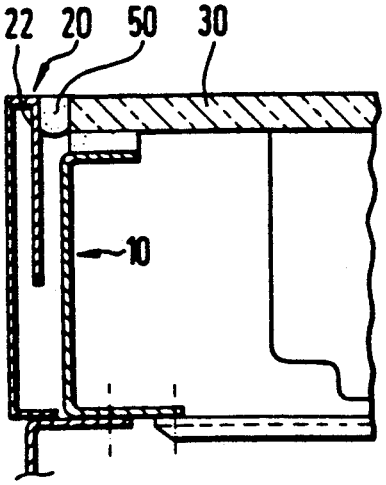
Figure 7:
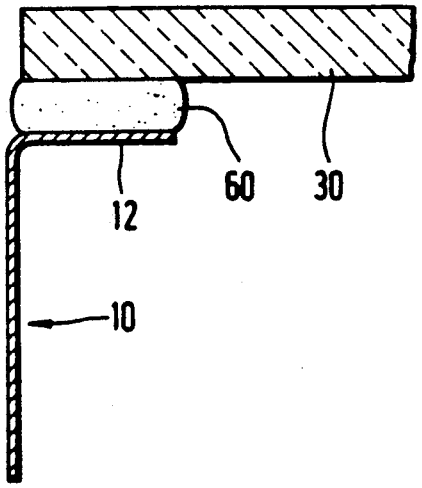
FIGS. 7–10 show in sections, a binding between the attachment frame and a glass ceramics plate, in cross-section.
Figure 8:
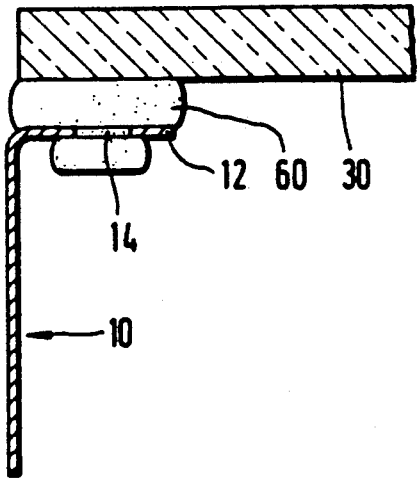

While the versions for built-in ranges have a bottom part 40*a* in addition to the base plate 40 as a rule, this is not the case for the upright stove version according to FIG. 2 (and FIGS. 4, 6).

Figure 3:
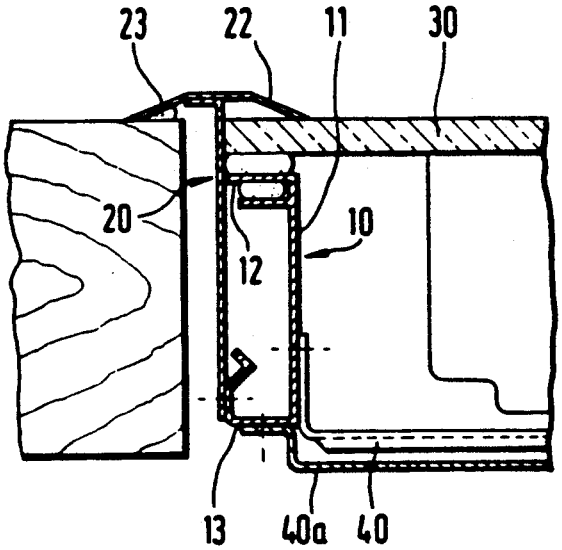
FIGS. 3–6 show circumferential areas of a cooking range in cross-section.
Figure 5:
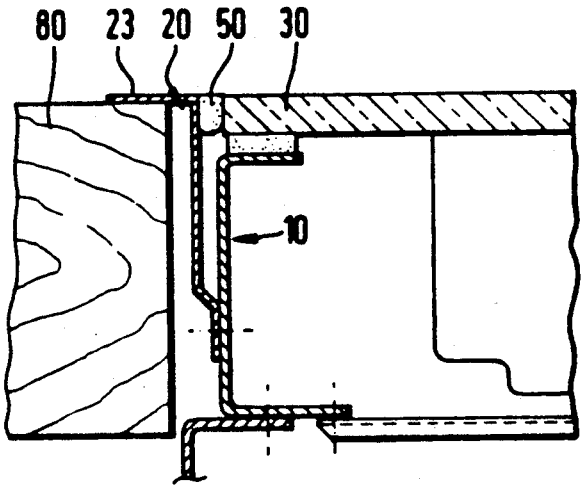

FIGS. 3 and 4 as well as FIGS. 5 and 6 form further pairs of versions with the same attachment frames 10 and individually adapted visual frames 20. While FIGS. 3 and 5 show versions for built-in kitchenettes, FIGS. 4 and 6 refer to versions for an upright stove. All positions that correspond to those in FIGS. 1 and 2 are given the same reference numbers.

In the form of construction according to FIGS. 1 and 2 the connecting flange 12 of the attachment frame 10 is bent toward the inside of the cooking range and is bonded with the cooking zone plate 30 in such a way that the lateral walls 11 of the cooking range are flush with the edge of the cooking zone plate. However, in the forms of construction according to FIGS. 3 and 4 the connecting flange 12 is bent toward the outside of the range and bonded with the plate 30 in such a way that the outer edge of the connecting flange is flush with the plate edge.

In this way it is possible to screw the base plate 40 onto the middle ridge 11 of the attachment frame 10 instead of attaching the base plate 40 at the connecting flange 13 of the attachment frame 10.

According to FIG. 3, the visual frame 20 is screwed on via an intermediate piece (not shown) which is in turn attached at the common attachment point between bottom part 40*a* and connecting flange 13 of the attachment frame 10.

Figure 9:
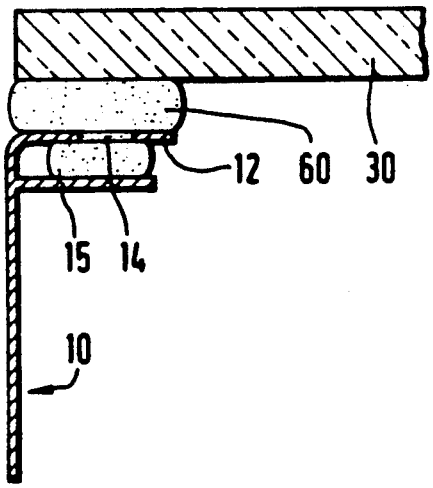

The connecting flange 12 of the attachment frame 10 of FIG. 3 (and FIG. 4) is connected via a specially designed binding with the edge of the cooking zone plate 30. This binding is explained in more detail with the help of FIG. 9. This binding can also be applied in the version corresponding to FIGS. 1 and 2. Inversely, in the version according to FIGS. 3 and 4 the bindings according to FIGS. 1 and 2 can be used. Generally speaking, all techniques shown in FIGS. 7–10 can be used alternatively with the versions described.

According to FIG. 4, the attachment frame 10 and the visual frame 20 have intermeshing beads 17 and 24, by which both frame parts 10 and 20 are connected with each other in form-locking manner. To allow mounting or dismantling, the visual frame 20 in turn consists, in accordance with the form of construction in FIG. 2, of four individual side parts screwed together.

In addition, in FIG. 4 a seal 70 is drawn in below the covering collar 22. With this measure a liquid-tight, hygienic closing with the glass ceramics plate 30 is obtained. Since the covering collar 22 indirectly rests via the seal 70 on the glass ceramics plate 30, process tolerances of the visual frame 20 can be equalized in order to guarantee a low-stress holding of the glass ceramics plate 30.

Other construction possibilities in the transition from the covering collars 22 to the surface of the cooking zone plate will be explained later alternatively.

Similar to the case in FIGS. 1 and 2, in the versions in FIGS. 3 and 4 there are various possibilities to connect the frame parts 10 and 20 among themselves and with the base plate 40 or the bottom part 40*a* and, in the case of upright stoves, with the other casing part of the stove. In these instances, the connection pieces of these elements are to be designed accordingly. For this the experts have plenty of connecting techniques that they will choose according to the requirements.

The versions according to FIGS. 1–4 represent only a portion of many versions of a modular system.

FIGS. 5 and 6 show a frame which, with respect to hygiene, is easy to clean. In this regard, between the visual frame 20 and the side edges of the glass ceramics plate 30 there is a circumferential seal 50 the upper surface of which snugly connects the upper edge of the glass ceramics plate 30 with the inside upper edge of the visual frame 20.

In the version according to FIG. 5—a built-in cooking range—the covering collar 23 is flush with the plate surface and bent toward the sill plate 80, whereas in the case of FIG. 6—upright stove—the covering collar 22 of the visual frame 20 is at first flush with the plate surface and before reaching the plate edge, it is once again bent downward at right angles. This creates a smooth, level surface that is easy to keep clean.

The expert has a number of known possibilities available for the seal 50. For example, a corresponding bonding agent can be used to produce the circumferential seal.

Figure 10:
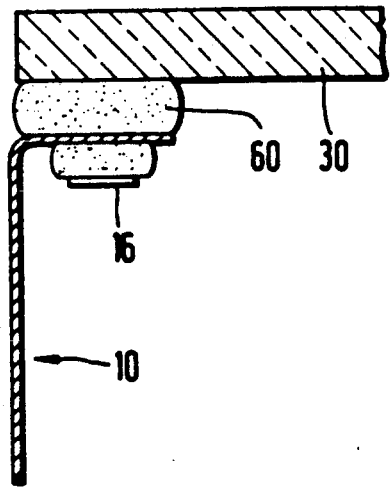

FIGS. 7–10 refer to differently structured bindings between the glass ceramics plate 30 and the attachment frame 10. Parts that are identical to each other or to those shown in FIG. 1 are given the same reference numbers. According to FIG. 7 a simply designed connecting flange 12 of the attachment frame 10 is connected via a bonding agent layer 60 with the lower edge of the glass ceramics plate 30 (see also FIG. 1/2). To obtain a durable binding to the frame part, it is necessary on the one hand that the adhesive surface of the attachment frame 10 be made of metal to have a high surface quality. In addition, the adhesive surface of the attachment frame must be carefully cleaned and treated with a subcoating. On the other hand, FIGS. 8–10 refer to versions in which recesses are arranged in the connecting leg 12. In this way an additional form closing is obtained, since in binding, adhesive 60 presses through the recesses and migrates behind them. Due to the additional form closing, pretreatment of the adhesive surface of the attachment frame 10 is less critical. Considering FIG. 8, the recesses represent bores 14 that are easy to produce. So that the adhesive flowing through the bores 14 during mounting cannot drip downward, a catching collar 15 is provided in FIG. 9. This catching collar 15 is arranged below the bores 14 and parallel to the connecting flange 12 of the attachment frame 10. Instead of the above described bores 14 in connection with a catching collar 15, as shown in FIG. 10, rear catching bars 16 formed by stamping and bending can also be used.

The bindings shown in FIGS. 7–10 can be used in each of the individual forms of construction of the modular system according to FIGS. 1–4.

For the design of the covering collar 22, 23 of the visual frame 20 there are several possibilities of construction that will be explained briefly with the following figures. These alternatives can also be used alternatively for the individual versions of the modular system or the connection of visual frames to the plate. In this sequence of illustrations as well, the same parts are given the same reference numbers, while for the sake of simplicity and clarity, mainly only the different positions are numbered.

FIGS. 11–13 show sections from a cooking range for a built-in stove, in which the visual frame has adjacent to the upper end of the middle range 21 a covering collar 22 bent toward the ceramic plate 30 as well as a collar 23 bent away from it. The connection of the frame part 10 with the plate 30 is chosen in accordance with the version in FIG. 7 as an example.

In the versions according to FIGS. 11 and 12, the covering collar 22 bent toward the ceramics plate 30 is connected in one piece in the manner of a hairpin loop with the other covering collar 23. In the version according to FIG. 11, the middle ridge 21 projects somewhat over the upper edge of the plate, with the covering collar 23 bent in the loop. The covering collar 22 runs in ramp shape out to the plate surface.

This type of covering is also the basis of the forms of construction according to FIGS. 1 and 3.

Figure 11A:
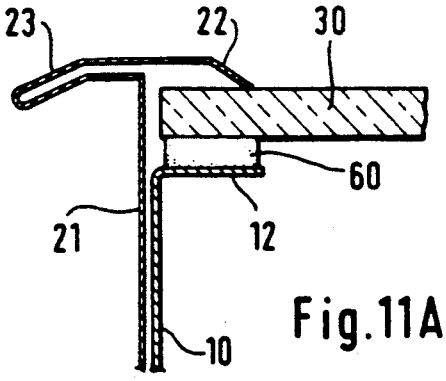
FIG. 11–16 show, in sections, a circumferential area of a cooking range in idealized cross-section with different designs of the covering collars of the visual frame and various versions of each.

In the simplest case of FIG. 11A, the ramp-shaped end of the covering collar 22 simply rests on the plate surface without seal strip or additional adhesive. This allows simple and rapid mounting or dismantling on the one hand, but leaves problems regarding waterproofness and hygiene. Inadmissible stresses on the cooking surface could also occur during mounting (tolerances, frame and cooking surface).

Figure 11B:
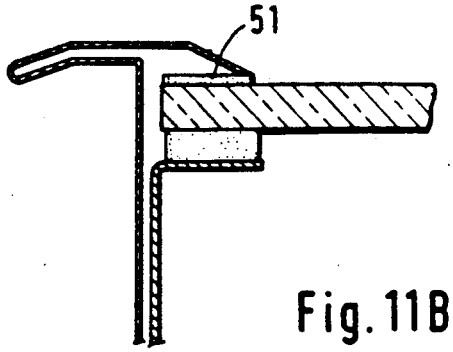

The version according to FIG. 11B provides for a seal strip 51 in the transition of the covering collar to the cooking zone plate. This version may well be hygienic and waterproof but requires additional mounting work with respect to cutting the seal-adhesive strip to size. The aforementioned inadmissible stresses in the cooking surface can also occur during mounting.

Figure 11C:
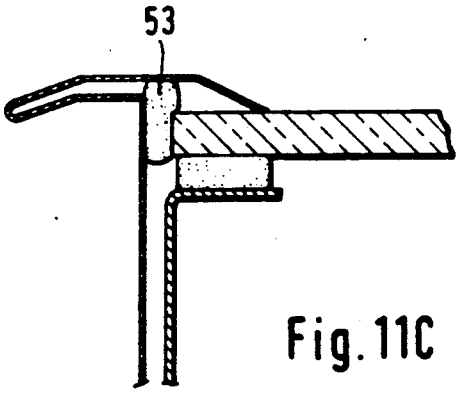

The version according to FIG. 11C provides for a circumferential adhesive seal 53 that only partially fills out the space below the covering collar at the level of the plate edge. This construction is waterproof and has a low stress, but leaves problems regarding hygiene because foreign substances that can no longer be removed can penetrate into the space below the ramp of the covering collar 22.

Figure 11D:
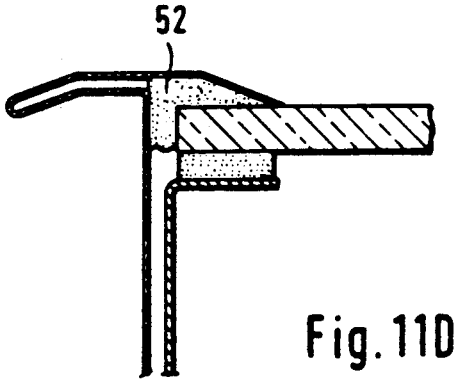

Finally, in the version according to FIG. 11D, a circumferential adhesive seal 52 is provided for that fills out the space below the covering collar 22 and between the middle ridge 21 and the plate's lateral edge. Such a design is waterproof, hygienic and has low stress but requires greater effort for mounting/dismantling.

In FIG. 12, in the versions A–C the middle range 21 closes snugly with the upper edge of the cooking zone plate 30, with the loop collar legs that form the covering collars 22 and 23 designed to run parallel throughout.

Figure 12A:
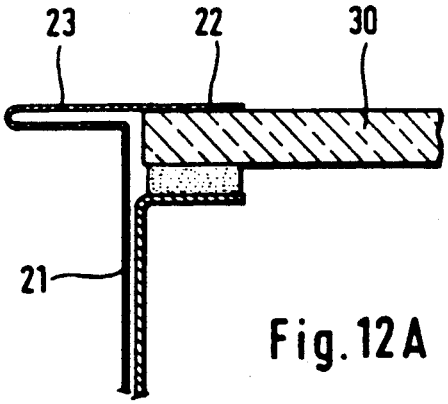
Figure 12B:
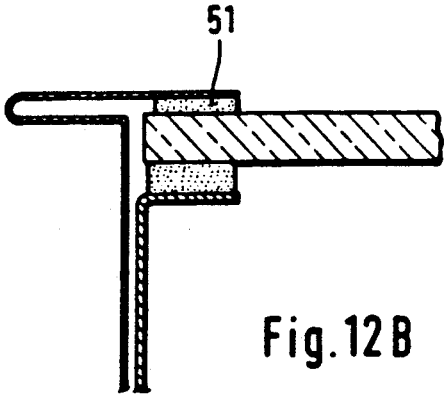

In the version according to FIG. 12A the flat covering collar 22 rests "loose" on the plate 30, whereas in the case of FIG. 12B an adhesive seal strip 51 is placed between the two, similar to the version in FIG. 11B.

Figure 12C:
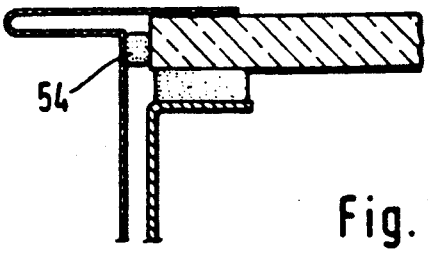
Figure 13A:
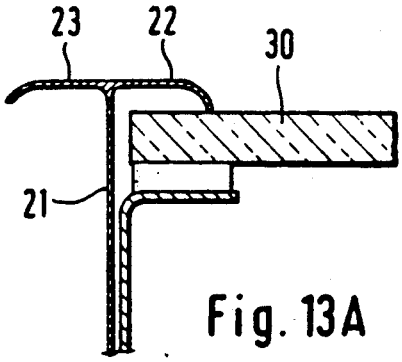
Figure 13B:
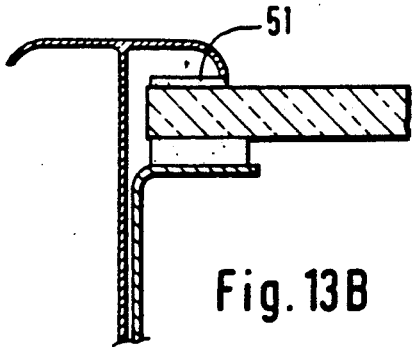
Figure 13C:
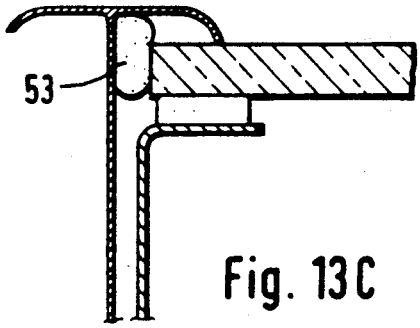
Figure 13D:
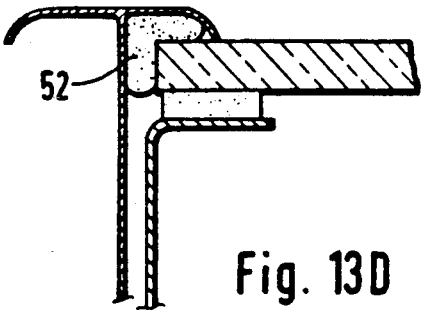
Figure 14A:
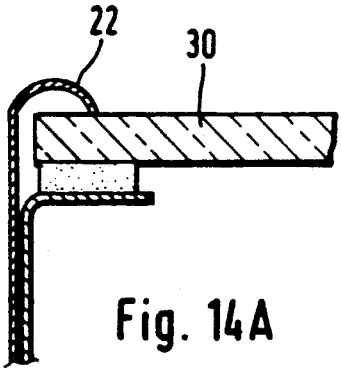
Figure 14B:
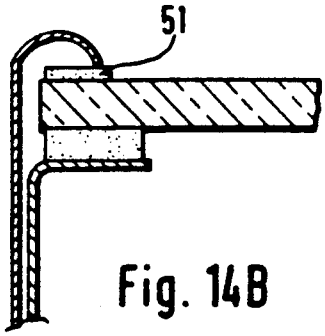
Figure 14C:
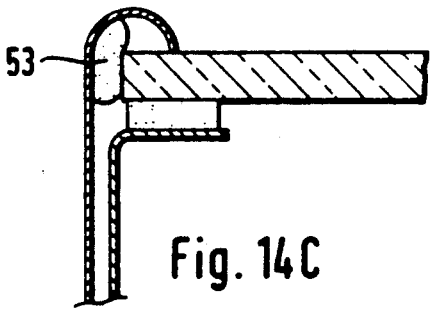
Figure 14D:
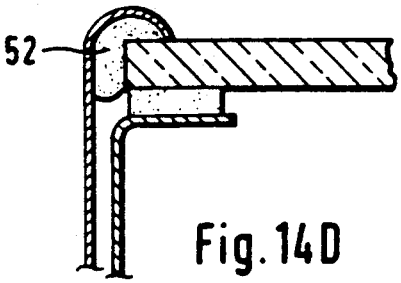
Figure 15A:
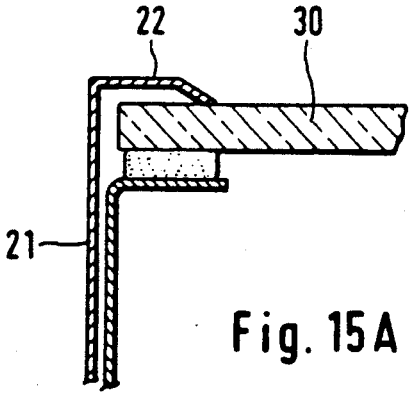
Figure 15B:
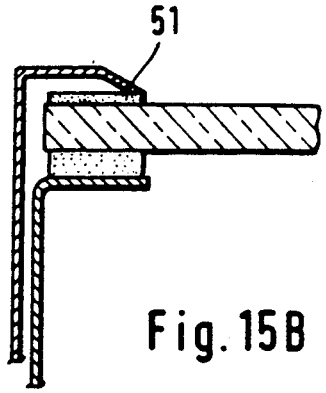
Figure 15C:
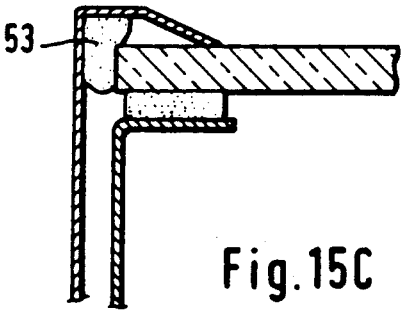
Figure 15D:
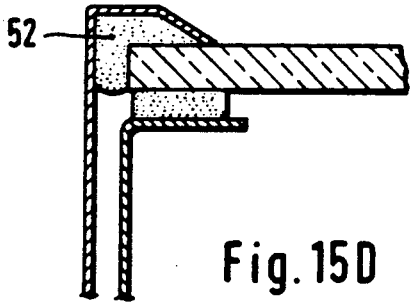

Finally, in the version according to FIG. 12C a circumferential (adhesive) seal 54 is provided for that completely fills out the space at the level of the plate's lateral edge. The individual advantages and disadvantages of the versions ensue analogously to the versions in FIGS. 11A through 11C.

In the form of construction according to FIG. 13 the two covering collars 22, 23 of the middle ridge 21 of the visual frame, as seen from the side, are shaped in the manner of a mushroom cover, with the cover half 22 resting at the edge on the cooking zone plate 30 (version 13A). In this form of construction as well, it is conceivable to provide for an adhesive strip 51 at the edge of the covering collar or its point of contact with the plate surface (version 13B).

Analogously to FIG. 11, a partial seal 53 or a complete seal 52 can be provided alternatively below the covering collar 22, with the already described advantages and disadvantages.

Figure 16A:
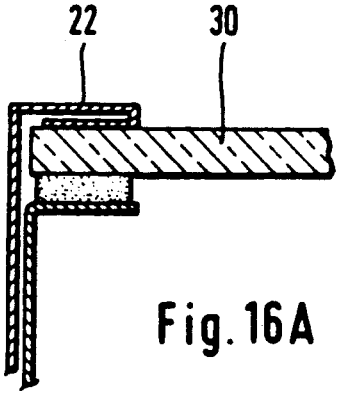
Figure 16B:
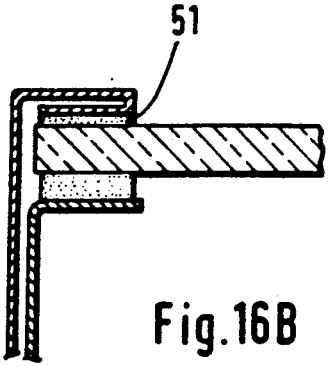
Figure 16C:
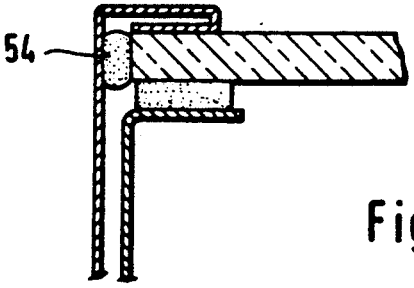

FIGS. 14–16 show three various forms Of construction for the design of the covering collar 22 of the visual frame for upright stoves, with various secondary versions in the transitional area to the cooking zone plate 30. In this case as well, only the essential elements are shown or given reference numbers.

In the form of construction according to FIG. 14 the covering collar is designed curved toward the plate. The overall cooking zone thus obtains a generally round appearance that appeals to certain clientele or is suited to styles of existing furniture. In the version in 14A the curve end rests directly on the plate 30, whereas in the case of version 14B, as in the already described versions B of FIGS. 11–13, a seal strip is attached to the plate surface. In versions 14C and 14D, on the other hand, a circumferential seal is provided, with the seal 53 filling only the space around the side edge of the plate while the seal 52 completely fills the space below the covering collar 22. The differences between the individual versions, i.e. their advantages and disadvantages, can be seen in the description of the corresponding versions of FIG. 11.

In the form of construction according to FIG. 15, the middle ridge 21 of the visual frame projects somewhat over the upper edge of the plate; the attached covering collar 22 is bent at the end in ramp-like manner toward the surface of the plate 30. This form of construction is already shown in FIGS. 2 and 4 in a larger context.

FIG. 15 also shows the different versions A–D corresponding to FIG. 11 with the direct contact according to 15A, the seal strip 51 (15B) placed between, the edge seal 53 according to version 15C and the seal completely enclosing the plate edge in accordance with version D.

In the form of construction according to FIG. 16 the covering collar 22 runs parallel to the surface of the cooking zone plate 30 throughout, with the edge somewhat flanged and resting in yielding manner on the plate surface (version A). In version B a seal strip 51 is placed between, while in version C, in accordance with version C in FIG. 12, the side edge of the plate 30 is surrounded by a circumferential seal 54.

Versions A–D or A–C of FIGS. 11–16 are not mutually exclusively versions. Combinations within the versions of a figure are possible.

FIGS. 11–16 show edge areas of a cooking range in idealized cross-section. In these areas, the covering collar 22 overlaps the glass ceramic plate.

Figure 17:
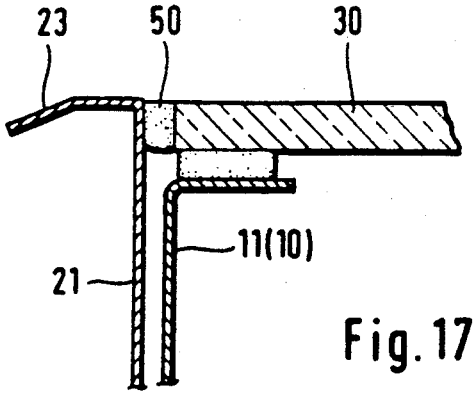
FIGS. 17–19 show, in sections, a circumferential area of a cooking range in idealized cross-section with a visible, subsequently added adhesive seam between visual frame and ceramic plate, with versions differing with respect to the collar of the visual frame.
Figure 18:
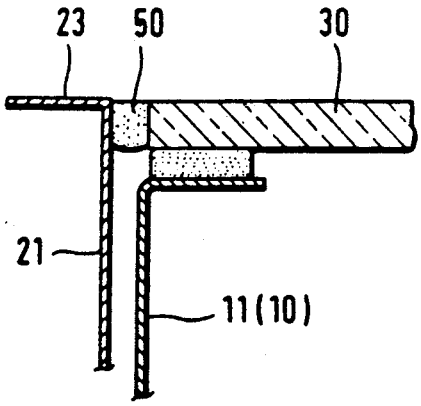
Figure 19:
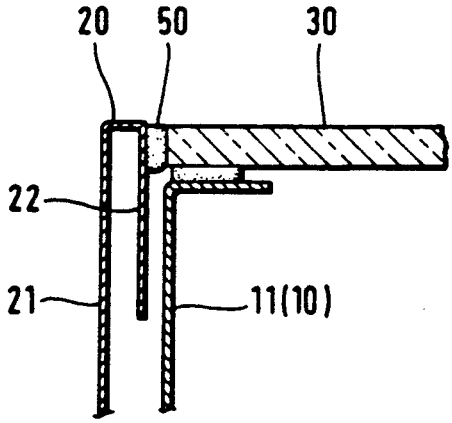
Figure 20:
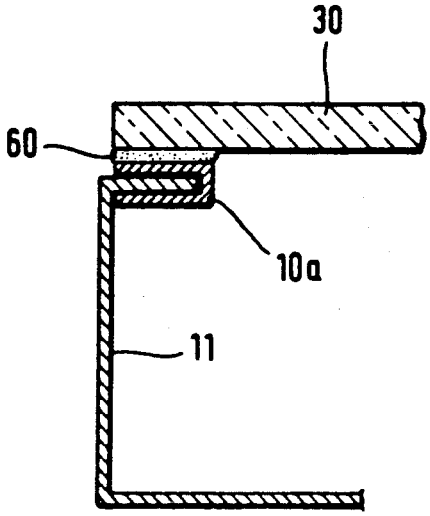
FIG. 20 shows, also in sections, a circumferential area of a cooking range/idealized cross-section with an adhesive frame as insertion system for attaching the frame, as an alternative form of construction to those in FIGS. 7–10.
Figure 21:
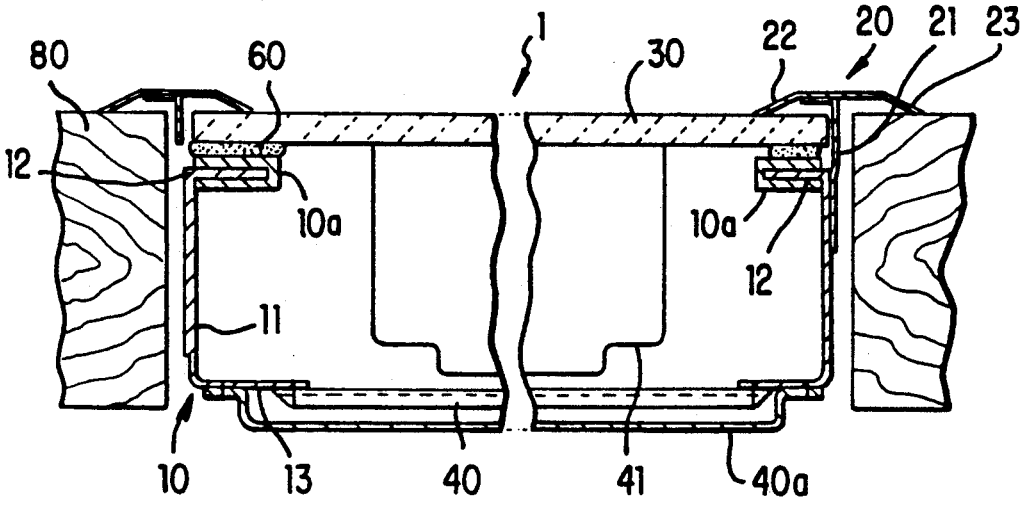
FIG. 21 shows a cooking range in cross section with a frame for a built-in stove in accordance with the embodiment of FIG. 20.
Figure 22:
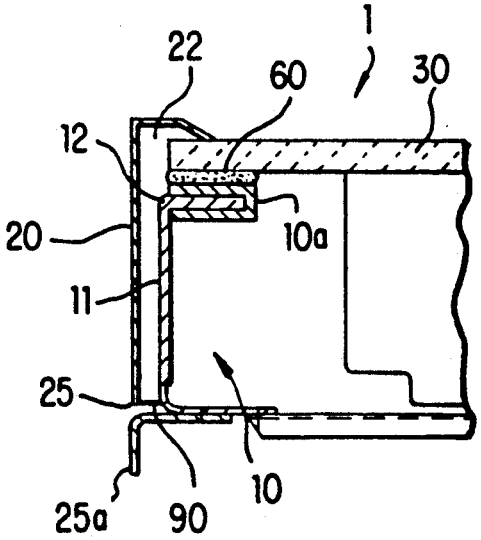
FIG. 22 shows the left circumferential area of the cooking range according to FIG. 21, but with a frame for an upright stove.
Figure 23:
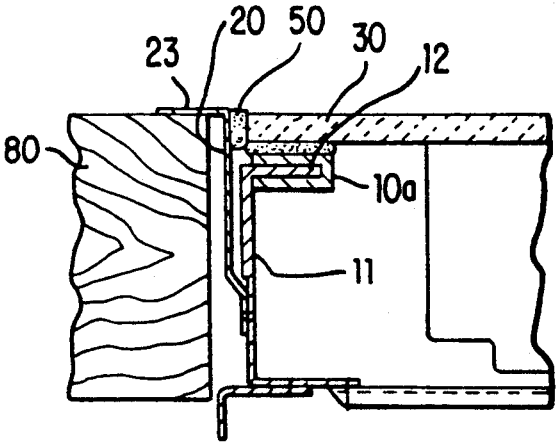
FIGS. 23 and 24 show circumferential areas of a cooking range in cross section in accordance with the embodiment of FIG. 20.
Figure 24:
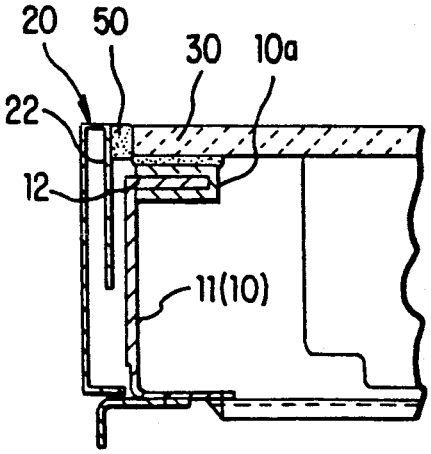
Figure 25A:
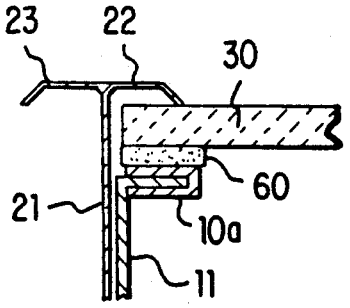
FIGS. 25 and 26 show, in sections, a circumferential area of a cooking range in idealized cross section with different designs of the covering collars of the visual frame and various versions of each in accordance with the embodiment of FIG. 20.
Figure 25B:
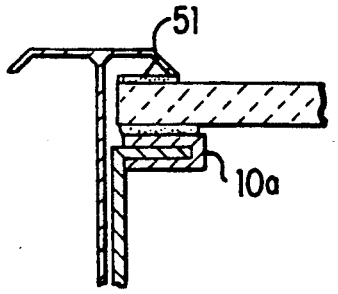
Figure 25C:
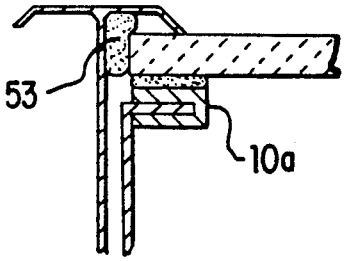
Figure 25D:
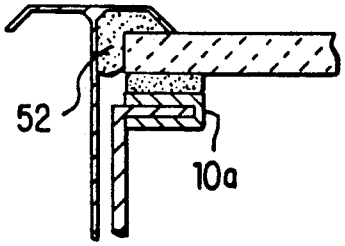
Figure 26A:
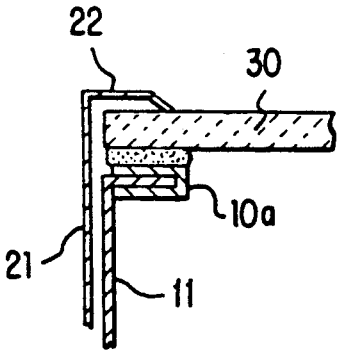
Figure 26B:
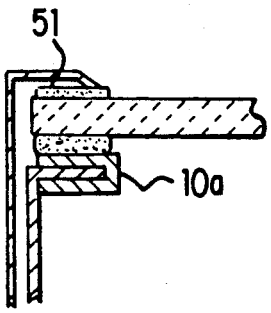
Figure 26C:
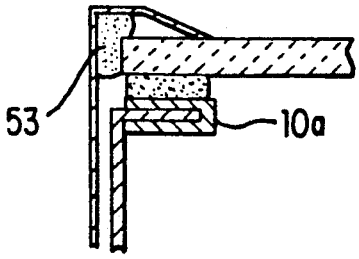
Figure 26D:
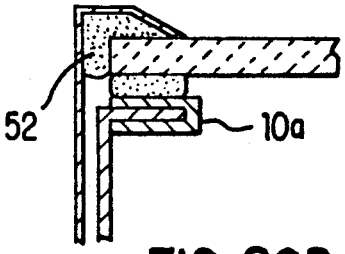
Figure 27:
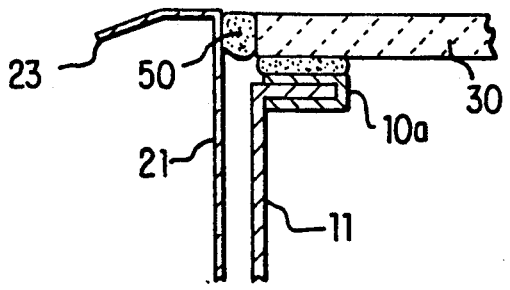
FIGS. 27–29 show, in sections, a circumferential area of a cooking range in idealized cross section with a visible subsequently-added adhesive seam between the visual frame and ceramic plate in accordance with the embodiment of FIG. 20, with versions differing with respect to the collar of the visual frame.
Figure 28:
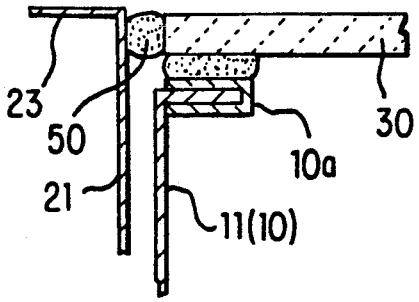
Figure 29:
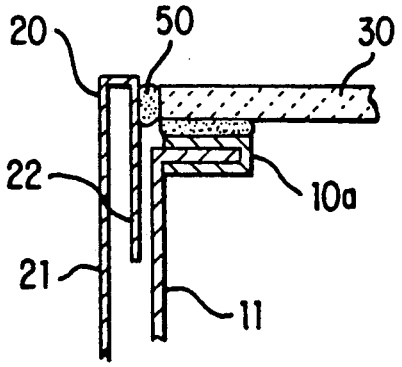

FIGS. 17–18 show similar cross--sections in which such overlapping does not occur. In these figures as well, same elements are given the same reference numbers. FIGS. 17 and 18 show the form of construction for a built-in cooking range (see also FIG. 5) while FIG. 19 shows a design for an upright stove (see also FIG. 6).

A common characteristic is that between the edge of the ceramic plate 30 on which the middle ridge 11 of the frame (10) is bonded and the middle ridge 21 of the visual frame 20, a visible, subsequently added adhesive seam is snugly attached by means of a permanently elastic, heat-resistant adhesive (e.g., silicone adhesive).

Such a construction is highly waterproof, low-stress and hygienic.

In the version according to FIG. 17 the covering collar 23 is bent, while in the case of the version according to FIG. 18, with predetermined installing conditions, it runs flat and horizontal throughout.

In the case of the built-in stove according to FIG. 19, the covering collar 22 of the visual frame 20 bends downward again before reaching the plate edge, in such a way that the section between the middle range 21 and the collar 22 is essentially flush with the plate surface.

In the forms of construction shown thus far the attachment frame 10 is designed in one piece with the lateral walls 11 and is bonded directly with the bottom of the plate 30 by means of the flange 12.

FIGS. 20–29 show a modified version in which an attachment frame 10*a* and the lateral wall 11 of the casing are designed as separate components. All elements that correspond with those in FIGS. 1–19 are given the same reference numerals. The attachment frame 10*a* consists in this instance of a profile frame which in cross-section has the form of a u. The upper leg of this u profile is bonded by means of an adhesive 60 with the bottom of the plate 30. The lateral wall 11 of the casing is provided with a flange at its upper end. With this flange it can be inserted into the u profile.

This form of construction, which is not limited to a certain cooking range, has several advantages:

Only the profile frame 10*a* that is bonded with the cooking surface needs to be made of stainless steel. The other components for the substructure can be made of simple, inexpensive steel plate (which is not suitable for bonding). This provides for considerable savings.

Another advantage is in the saving of transport volumes when shipping. As a rule, ceramic plates including the bonded frames are shipped as a subassembly to the cooking range manufacturer. With the frame bonded on, the result is a fairly cumbersome piece of merchandise. In the form of construction according to FIG. 20–29 the plate 30 only needs to be packaged with the profile frame 10*a* bonded on. The remaining parts of the frame only need to be inserted into the profile frame 10*a* at the cooking range manufacturer's facility.

In the version according to FIGS. 20–29, the opening of the u-shaped profile frame faces outward. Similar to FIGS. 3 and 4, the profile frame can also be bonded to the plate in such a way that the opening faces toward the inside of the range.

Figure 30:
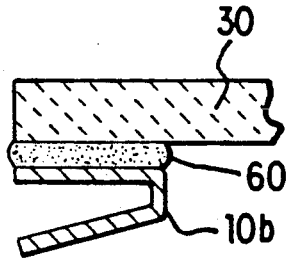
FIGS. 30 and 31 are partial section views of modified U-shaped profile frames having divergent lower legs.
Figure 31:
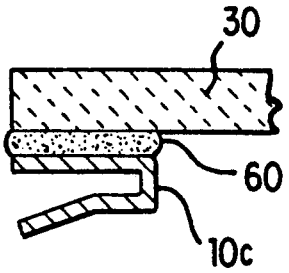

The legs of the u-shaped (in cross-section) profile frame 10*a* do not necessarily have to run parallel to each other. As shown in FIGS. 30 and 31, modified U-shaped profile frames 10*b* and 10*c* may be formed. Starting from the base of the u-shaped cross-section, the legs can run divergent, with the lower free leg forming a sharp angle with the upper leg bonded onto the plate 30. The lower leg can also be bent downward at its end to form a broader insertion opening for the flange 12.

The frame can be designed in one piece all the way around or in several pieces. In particular, the attachment frame 10 with its flange 12 can also consist of several partial pieces arranged distributed over the periphery of the plate 30.

We claim:

1. A cooking range comprising:

a plate of glass, glass ceramics or a similar material, said plate having a top surface, a bottom surface, and a peripheral edge;

a framing means for framing the plate including attachment means that are bonded to the bottom surface of the plate, and means for edge protection and lateral closing of the plate; and a cooking range casing that surrounds the plate at its bottom and has lateral walls and a bottom part, said lateral walls having a bent flange at an upper end thereof;

wherein the attachment means of the framing means have an attachment frame (10) formed with a cross section profile in the shape of a lying "U", said cross section profile having an upper leg and a lower leg, said upper leg having an uppermost surface which is bonded with said bottom surface of the plate (30) such that said attachment frame is disposed completely beneath said plate, the attachment frame removably receiving said flange of the cooking range casing after the attachment frame is bonded to the bottom surface of the plate, and the means for edge protection and lateral closing of the plate (30) includes a visual frame (20) separate from the lateral walls (11) of the cooking range casing and a sealing mass sealingly disposed between said visual frame and said peripheral edge of said plate, said sealing mass being separate from said attachment frame.

2. A cooking range according to claim 1, wherein the u profile is open toward the cooking plate periphery.

3. A cooking range according to claim 1, wherein the u profile is open toward the center of the cooking plate.

4. A cooking range according to claim 1, wherein the legs of the u profile diverge toward the opening of the profile.

5. A cooking apparatus comprising:

a cooking plate of glass, glass ceramics or a similar material, said plate having an upper surface, a bottom surface, and a peripheral edge;

a two-part mounting frame to receive and fix the cooking plate in a cooking range, the mounting frame comprising a standardized supporting frame part (11) and a profile frame part (10*a*, 10*b*, 10*c*) of low total height bonded to the bottom surface of the cooking plate (30) such that said profile frame part is disposed completely beneath said bottom surface of the plate, said profile frame part (10*a*, 10*b*, 10*c*) being constructed to removably receive an end of the supporting frame part (11) after being bonded to the cooking plate; and a visual frame (20) formed separately from the two-part mounting frame for edge protection and lateral closing of the cooking plate.

6. A cooking apparatus according to claim 5, wherein the receiving end of the supporting frame part (11) and the profile frame part (10*a*, 10*b*, 10*c*) are so constructed that they are mechanically connectable by inserting the supporting frame part into the profile frame part.

7. A cooking apparatus according to claim 6, wherein the profile frame part (10*a*) is constructed with a cross section profile in the shape of a lying U, said cross section profile having an upper leg and a lower leg, said upper leg having an uppermost surface which is bonded with the bottom surface of the plate (30), whereby a flange of the supporting frame part (11) can be inserted in the U-profile.

8. A cooking apparatus according to claim 7, wherein the U-profile (10*a*) is bonded to said plate so as to be open towards the cooking plate periphery.

9. A cooking apparatus according to claim 8, wherein at least the upper leg of the U-profile (10*a*) snugly closes with the lower edge of the plate (30).

10. A cooking apparatus according to claim 7, wherein the U-profile (10*a*) is bonded to said plate so as to be open towards the center of the plate, and the upper leg of the U-profile snugly closes with the lower edge of the plate.

11. A cooking apparatus according to claim 7, wherein the lower leg of the U-profile (10*b*, 10*c*) is formed to be at least partly bent downward whereby the opening of the U-profile diverges.

12. A cooking apparatus according to claim 5, wherein the profile frame part (10*a*, 10*b*, 10*c*) is constructed as a single-part frame completely embracing the circumference of the lower edge of the plate.

13. A cooking apparatus according to claim 5, wherein the profile frame part (10*a*, 10*b*, 10*c*) is constructed as a multi-part frame completely embracing the circumference of the lower edge of the plate.

14. A cooking apparatus according to claim 5, wherein the profile frame part (10*a*, 10*b*, 10*c*) comprises partial sections which are spaced along the circumference of the lower edge of the plate (30).

15. A cooking apparatus according to claim 5, wherein the visual frame (20) has adjacent to an upper end thereof a covering collar (22) bent toward the plate (30).

16. A cooking apparatus according to claim 5, wherein the visual frame (20) has adjacent to an upper end thereof a covering collar (23) bent away from the plate (30).

17. A cooking apparatus according to claim 5, wherein the visual frame (20) has adjacent to an upper end thereof a covering collar (22, 23) both bent towards and bent away from the plate (30).

18. A cooking apparatus according to claim 15, wherein a middle ridge (21) of the visual frame (20) slightly projects above the upper edge of the plate and the covering collar (22) bent towards the plate (30) is also bent at its free end in ramp shade towards the upper surface of the plate.

19. A cooking apparatus according to claim 17, wherein a middle ridge (21) of the visual frame (20) slightly projects above the upper edge of the plate and the covering collar (22) bent towards the plate (30) is also bent at its free end in ramp shade towards the upper surface of the plate.

* * * * *